US008118307B2

(12) United States Patent
Young

(10) Patent No.: US 8,118,307 B2
(45) Date of Patent: Feb. 21, 2012

(54) BIBLE WALK BOARD GAME

(76) Inventor: Shirley Clanton Young, Bowie, MD (US)

( * ) Notice: Subject to any disclaimer, the term of this patent is extended or adjusted under 35 U.S.C. 154(b) by 0 days.

(21) Appl. No.: 12/461,208

(22) Filed: Aug. 4, 2009

(65) Prior Publication Data

US 2011/0031690 A1 Feb. 10, 2011

(51) Int. Cl.
*A63F 3/00* (2006.01)

(52) U.S. Cl. ..... 273/242; 273/432

(58) Field of Classification Search ..... 273/242, 273/259, 430, 431, 432
See application file for complete search history.

(56) References Cited

U.S. PATENT DOCUMENTS 4,940,239 A * 7/1990 Tuttle ..... 273/243
5,211,402 A * 5/1993 Ferguson et al. ..... 273/249
5,529,308 A * 6/1996 Masakayan ..... 273/243
6,547,245 B1 * 4/2003 Olutunfese ..... 273/248

* cited by examiner

*Primary Examiner* — Vishu Mendiratta

(57) ABSTRACT

A board game, Bible Walk provides fun while testing one's knowledge of the bible and teaches as you play. The game Bible Walk is designed to be and interactive multi-player game which includes a board, playing pieces and an electronic device which displays questions. The board is generally rectangle on which the players would move their pieces around the board. The board has colors and writings on the squares as well as on the center of the board. The electronic device contains questions from Genesis to Revelation from the Holy Bible. The players must answer short questions correctly in order to move to the next square. All questions are T-true or F-false. The game is meant to move at a fast pace. The first player or group of players to land on the well done square wins. Game may continue with other players for second or third and so on if players desire.

1 Claim, 11 Drawing Sheets

| | | | | | |
|---|---|---|---|---|---|
| Romans | 1Corinthians | 2Corinthians | Galatians | Ephesians | Philippians |
| 2 King | 1Chronicles | 2Chronicles | Ezra | Nehemiah | Esther |

FIGURE 1D

| | | | | | | | | |
|---|---|---|---|---|---|---|---|---|
| Q:<br>A: | | | Walk on or Try Again | | | | | |
| F | | | Bible Walk | | | | | T |
| Gen | Ex | Lev | Num | Deu | Jos | Jud | Rut | 1Sam |
| 2Sam | 1K | 2K | 1Chr | 2Chr | Ezr | Neh | Est | Jb |
| Ps | Prv | Ecc | SoS | Isa | Jer | Lam | Eze | Dan |
| Hos | JL | Amo | Ob | Jon | Mic | Nah | Hab | Zep |
| Hag | Zec | Mal | Mat | Mk | Lk | Jhn | Act | Rom |
| 1Co | 2Co | Gal | Eph | Phi | Col | 1Th | 2Th | 1Ti |
| 2Ti | Tit | Phm | Heb | Ja | 1P | 2P | 1J | 2J |
| 3J | Jude | Rev | Beginner | | Random | | ON | OFF |

FIGURE 3A

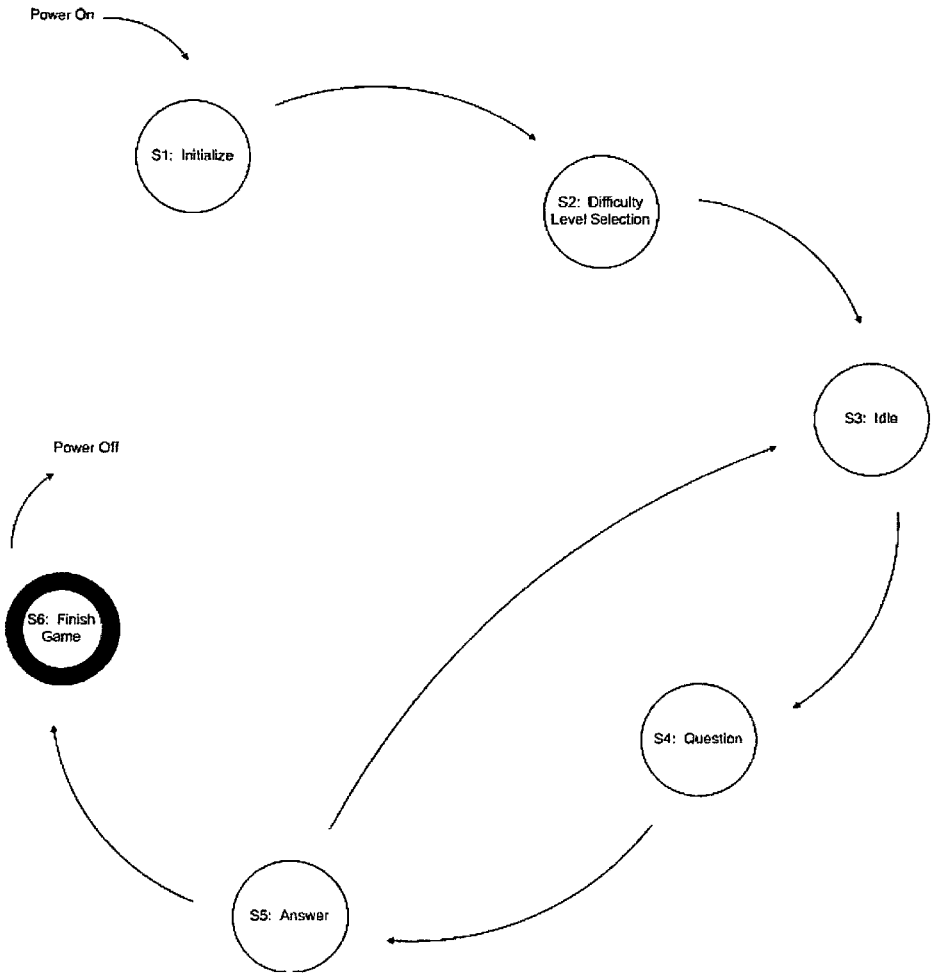
Figure 3B: State Diagram

BIBLE WALK BOARD GAME

BACKGROUND OF THE INVENTION

1. Field of the Invention

There are different color pieces in the game to move around the broad. The board has different colors on it and names of the books of the bible. It is a board game that could be made with any kind of material with an electronic game device needed to play. This game could be made into a desk top, lap top, hand held computer game or on CD. There are directions to play the game. It is a true or false game base on the bible.

2. Brief Description of Art

This is board game Bible Walk is base on questions taken from the Holy Bible.

The game includes:

FIG. 1A-1H: a board to play the game on, the board has different colors and names of the books of the bible. 1B-1H is the close-up drawings of the board to the game.

FIG. 2: pieces to move around the broad also have different colors.

FIG. 3: electronic device which is where the question will come from. The device may be any color.

SUMMARY OF INVENTION

The present invention, briefly described, is a board game named Bible Walk, designed to provide fun while testing one's knowledge of the bible and learning as you play. It is designed to be an interactive multi-player game which includes a board, game pieces to move around the board and an electronic device that provide questions. The board is generally rectangular and may fold; the board has a playing surface which has a number of squares with printing thereon. The squares go in a line and curve around to the inside of the board until the last square is reached. The electronic device houses the question for the game. The object of the game is to be the first to reach the well dome mark before the other players.

BRIEF DESCRIPTION OF THE DRAWINGS

The Board FIG. 1A-1I

The board is generally rectangular and may fold; the board has a playing surface which has a number of squares with printing thereon. The squares go in a line and curve around to the inside of the board until the last square is reached. With the names of the books of the bible and initials of the books of the bible.

Figure 1A:
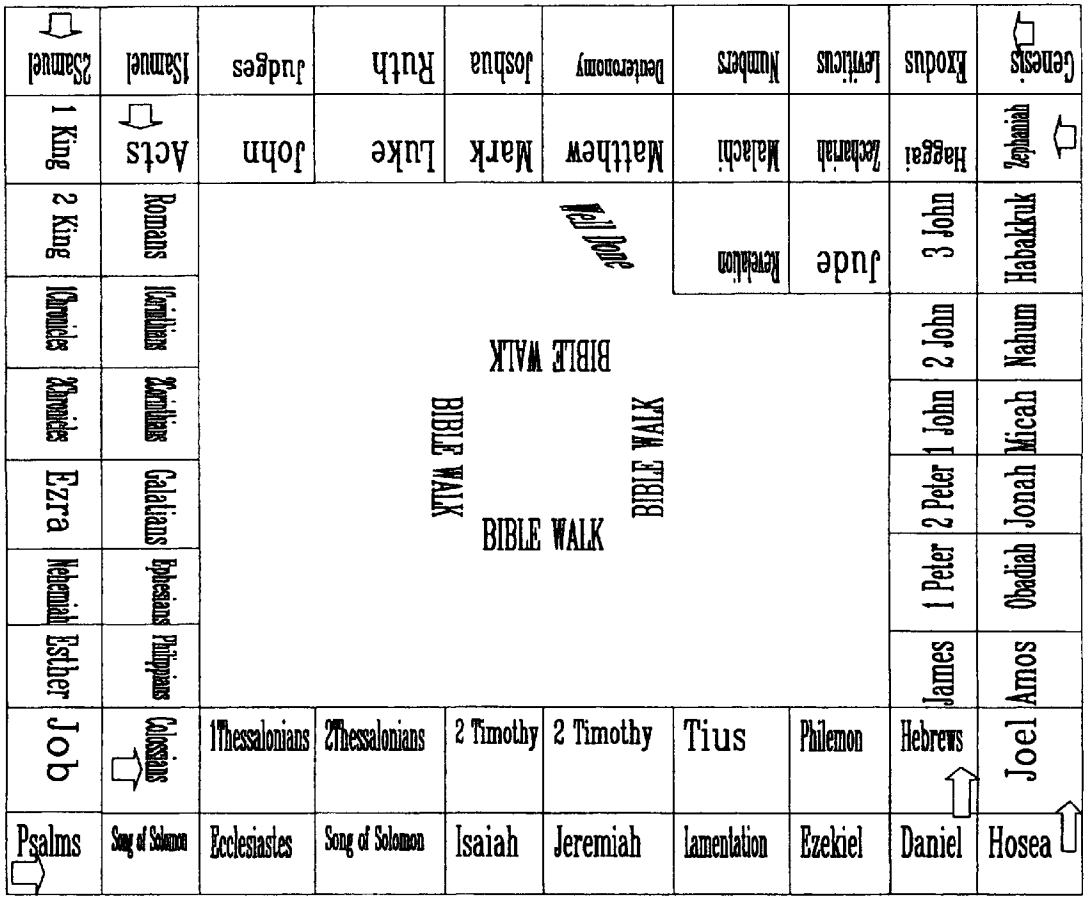
Figure 1B:
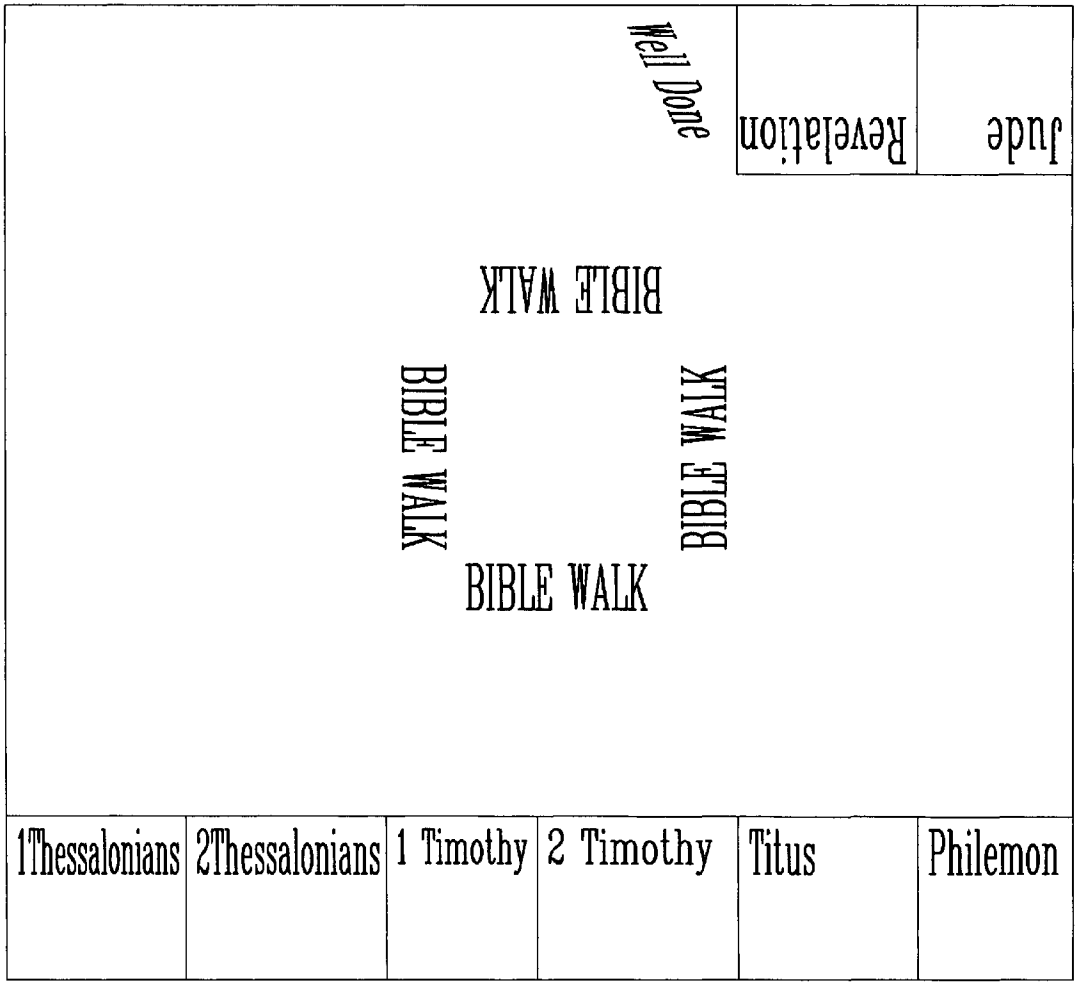
Figure 1C:
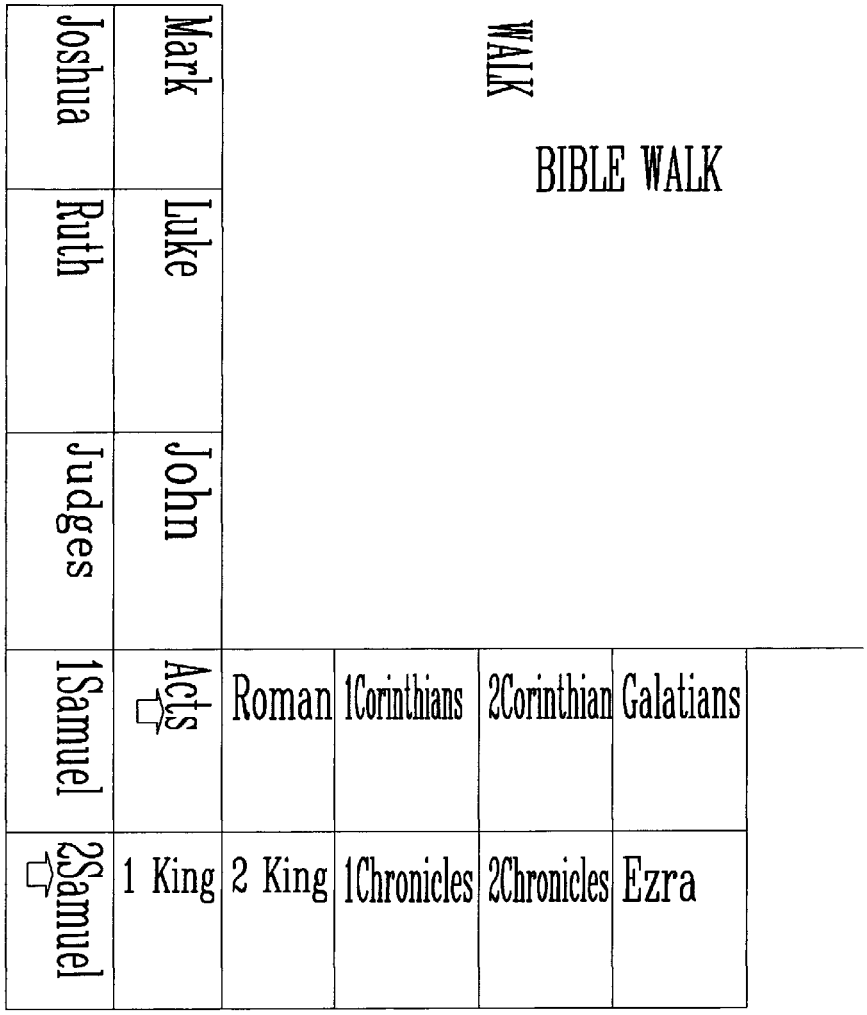
Figure 1E:
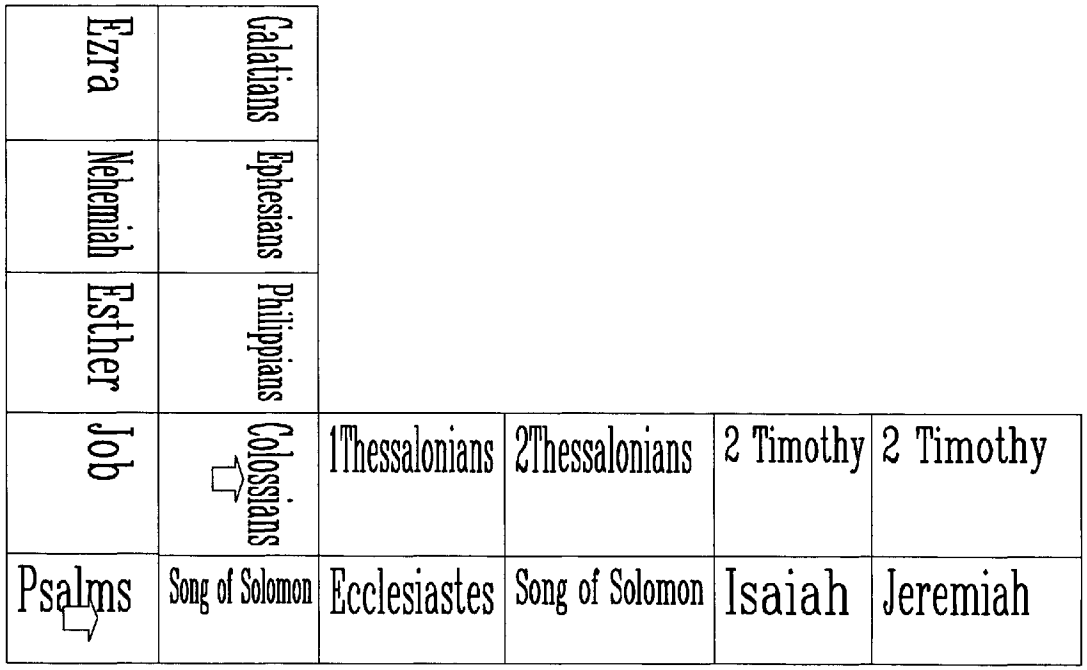
Figure 1F:
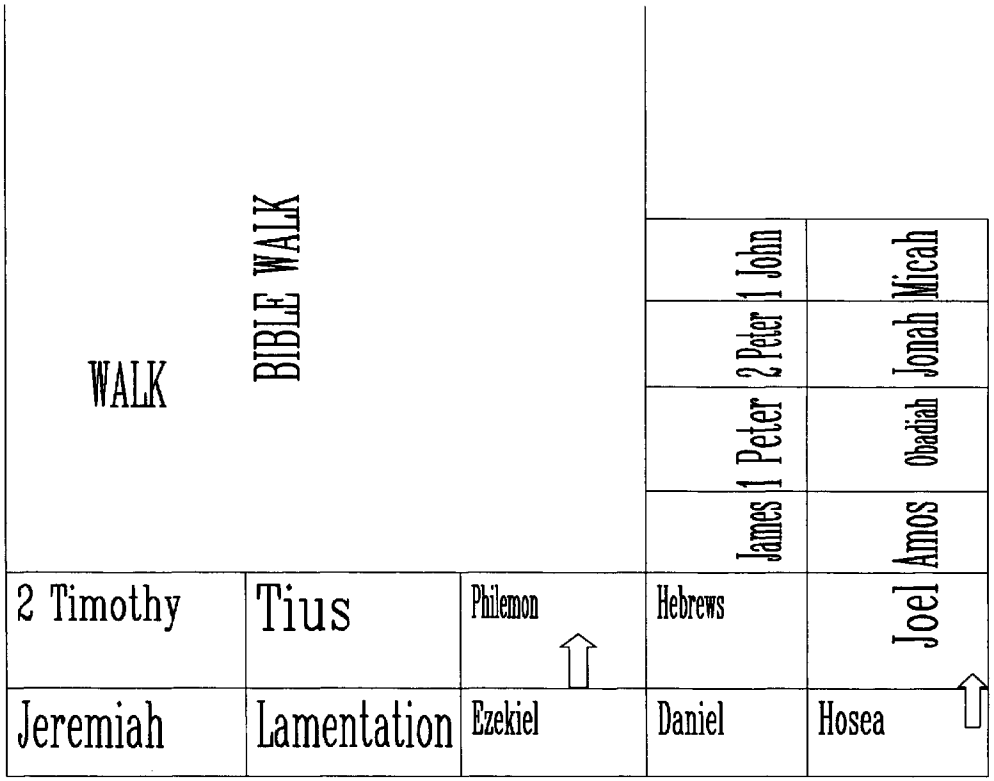
Figure 1G:
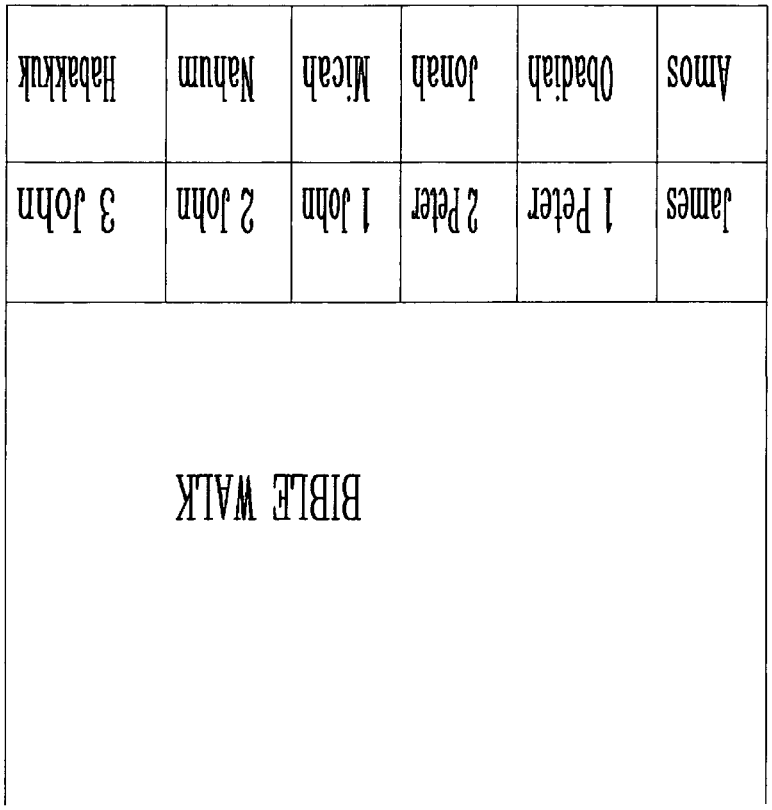
Figure 1H:
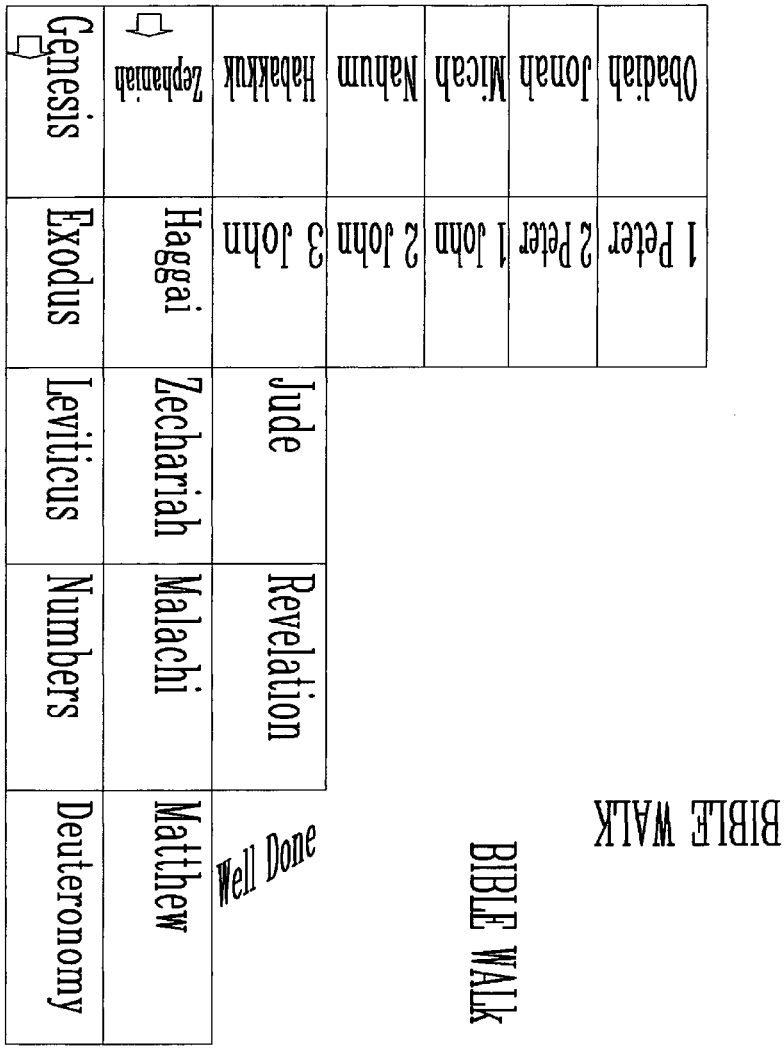
Figure 2:
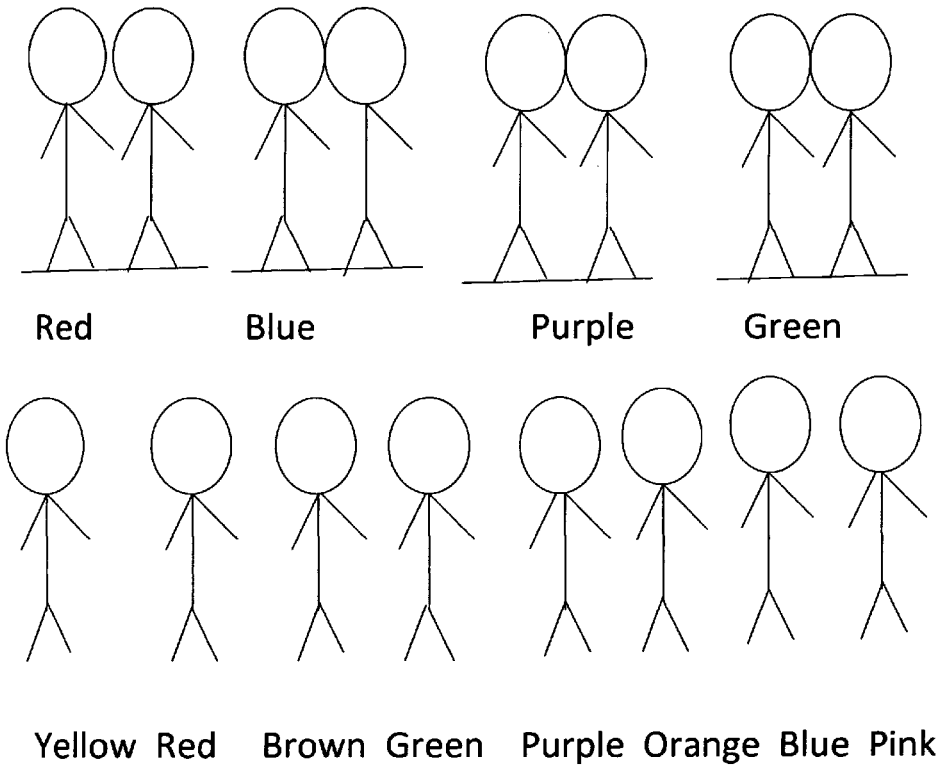

Game Pieces FIG. 2

There are game pieces to move around the board.

Electronic Device (Game Box or Question Box) FIG. 3

Off and On button
Button for each books of the Bible
Beginners and Random Button
Screen for the question to be displayed
T—True and F—False button
Timer starts when a player presses the button for a question
Buzzer will sound if question is not answer in time allowed If answer is correct player will hear (Walk On)
If answer is incorrect player will hear (Try Again)
There will be random skips in the game; if a player receives a skip the player will hear (Favor Walk On).

RULES AND METHOD OF PLAY

Place all players at Genesis to start.
Turn game box (electronic device) on and set to Beginner or Random
Press the Genesis button read the question and press T for True
Or F for False. Player have has 15 second to read and answers their question before the buzzer sounds. Then pass the game box to the left the game is meant to move at a fast pace.
If the answer is correct you will hear (Walk On) and it will appear on screen. If the answer is not correct you will hear (Try Again) it will appear on screen and the buzzer will sound.
Question should always be read aloud when playing singles, couples or teams.
Decide who will read the question when playing teams.
When playing teams divide into two teams and use two of the colors pieces. If it is guys against the girls choose pink and the blue.
Follow the colors around the board at the end of each color the arrow will point players to next color of books.
Game Over is When:
- Single players: First player to reach (Well Done) wins. Other players may continue game for $2^{nd}$ to $8^{th}$ place or just stop the game when the first person wins.
- Couples: First couples to reach (Well Done) wins. Other players may continue game to play for $2^{nd}$ through $4^{th}$ place or stop the game when the first couple wins game.
- Teams: First team to reach (Well Done) wins. Game Over

I claim:

1. A bible board game consisting of:

a game board consisting of 66 spaces, each space written with one of a 66 different bible names from the list consisting of Genesis, Exodus, Leviticus, Number, Deuteronomy, Joshua, Judges, Ruth, 1Samuel, 2Samuel, 1Kings, 2Kings, 1Chronicles, 2Chronicles, Ezra, Nehemiah, Esther, Job, Psalms, Proverbs, Ecclesiastes, Song of Songs, Isaiah, Jeremiah, Lamentations, Ezekiel, Daniel, Hosea, Joel, Amos, Obadiah, Jonah, Micah, Nahum, Habakkuk, Zephaniah, Haggai, Zechariah, Malachi, Matthew, Mark, Luke, John, Acts, Romans, 1Corinthians, 2Corinthians, Galatians, Ephesians, Philippians, Colossians, 1Thessalonians, 2Thessalonians, 1Timothy, 2Timothy, Titus, Philemon, Hebrews, James, 1Peter, 2Peter, 1John, 2John, 3John, Jude, Revelation;

a set of twelve game pieces consisting of two red pieces, two blue pieces, two purple pieces, two green pieces, and one each of yellow, brown, orange and pink piece; and a handheld electronic device having buttons indicating on, off, beginners, random, true, false, a screen for question and answer, a timer, a buzzer, a sound generator sounding "walk on" if answer is correct and "try again" if answer is wrong.

* * * * *